US006652391B1

(12) United States Patent
Kubica et al.

(10) Patent No.: US 6,652,391 B1
(45) Date of Patent: Nov. 25, 2003

(54) GOLF CLUB HEAD WITH VARIABLE THICKNESS FRONT WALL

(75) Inventors: Daniel J. Kubica, Peoria, AZ (US); David E. Wright, Glendale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/179,094

(22) Filed: Jun. 25, 2002

(51) Int. Cl.[7] ..... A63B 53/04
(52) U.S. Cl. ..... 473/345; 473/346; 473/349
(58) Field of Search ..... 473/324, 329, 473/332, 345, 346, 349, 350

(56) References Cited

U.S. PATENT DOCUMENTS

| | | | | |
|---|---|---|---|---|
| 1,485,685 | A | | 3/1924 | McMahon |
| 2,460,435 | A | | 2/1949 | Schaffer |
| 2,809,838 | A | | 10/1957 | Oquist |
| 4,511,145 | A | | 4/1985 | Schmidt |
| 4,957,294 | A | | 9/1990 | Long |
| 5,028,049 | A | | 7/1991 | McKeighen |
| 5,141,230 | A | | 8/1992 | Antonious |
| 5,163,682 | A | | 11/1992 | Schmidt |
| 5,261,663 | A | | 11/1993 | Anderson |
| 5,586,948 | A | | 12/1996 | Mick |
| 5,649,872 | A | * | 7/1997 | Antonious |
| 5,695,411 | A | * | 12/1997 | Wright |
| 5,711,722 | A | * | 1/1998 | Miyajima |
| 5,766,094 | A | | 6/1998 | Mahaffey |
| 5,776,011 | A | | 7/1998 | Su |
| 5,954,596 | A | | 9/1999 | Noble |

* cited by examiner

*Primary Examiner*—Sebastiano Passaniti
(74) *Attorney, Agent, or Firm*—Darrell F. Marquette

(57) ABSTRACT

A golf club head includes a body with a top wall, a bottom wall, and a front wall arranged for impacting a golf ball. The front wall has an inner surface and an outer surface. The front wall varies in thickness and has a bulging area of increased thickness on its inner surface. The bulging area of increased thickness includes a generally ring shaped mass that projects rearwardly from the front wall. A generally cone shaped mass, that also projects rearwardly from the front wall, may be located inside the ring shaped mass.

8 Claims, 7 Drawing Sheets

GOLF CLUB HEAD WITH VARIABLE THICKNESS FRONT WALL

BACKGROUND OF THE INVENTION

This invention relates generally to golf clubs and, in particular, to a golf club commonly referred to as a "driver".

Recent developments in golf club design have included improvements in drivers which are used primarily to strike a golf ball resting on a golf tee. These improvements have resulted in drivers with club heads consisting of a hollow shell usually made of metal such as steel, aluminum or titanium. These hollow shells have relatively thin walls including a thin front wall which is used to impact a golf ball. In order to prevent the front wall of these hollow shells from permanently deforming upon ball impact, it has become necessary to reinforce them. One example of a golf club head consisting of a hollow metal shell with a reinforced front wall is disclosed in U.S. Pat. No. 4,511,145 to G. Schmidt. The club head disclosed in the Schmidt patent has an arched ridge extending between heel and toe ends of the front wall. Another example of a golf club head with a reinforced front wall in a hollow metal shell is disclosed in U.S. Pat. No. 5,028,049 to J. McKeighen. In the McKeighen club head, the front wall of the hollow shell has an increased overall thickness but it is thinnest at its geometrical center.

SUMMARY OF THE INVENTION

In one embodiment of the present invention, a golf club head is comprised of a body having a top wall, a bottom wall, and a front wall arranged for impacting a golf ball. The front wall has an inner surface and an outer surface. The front wall varies in thickness and has a bulging area of increased thickness on its inner surface. The bulging area of increased thickness includes a ring shaped mass that projects rearwardly from the front wall. The front wall has a geometric center, and the ring shaped mass preferably encircles this geometric center. In another embodiment of the present invention, the front wall also has a cone shaped mass inside the ring shaped mass. The cone shaped mass projects rearwardly from the front wall and is preferably located at the geometric center of the front wall.

DESCRIPTION OF THE INVENTION

Figure 1:
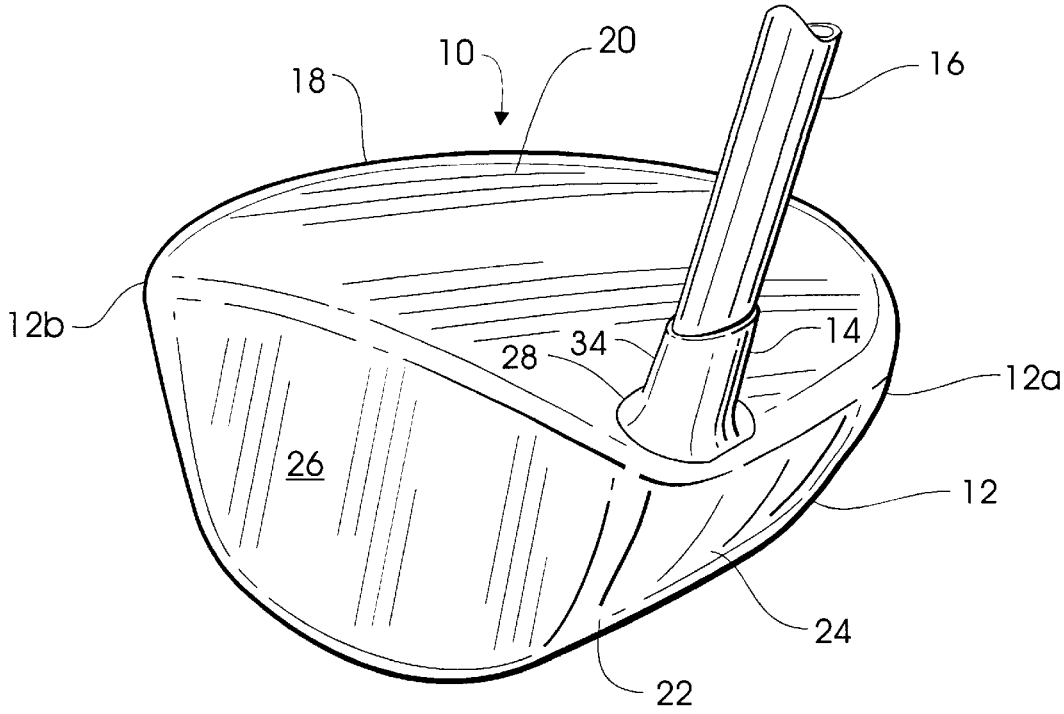
FIG. 1 is a perspective view of a golf club, partially broken away.
Figure 1A:
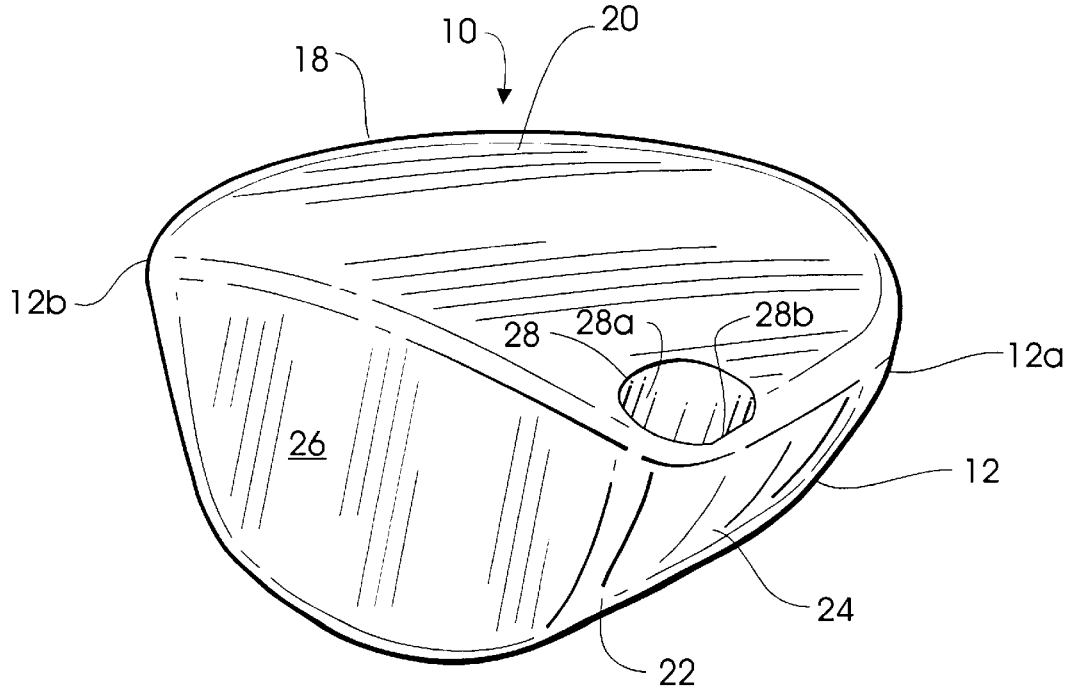
FIG. 1*a* is a perspective view of one part of the golf club shown in FIG. 1.
Figure 1B:
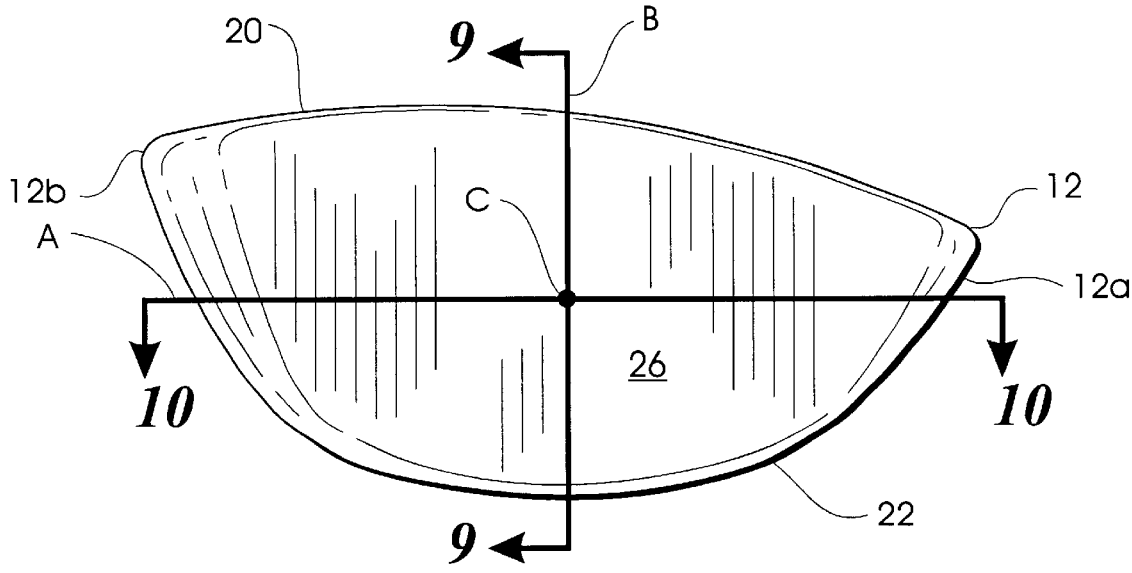
FIG. 1*b* is a front elevational view of the part shown in FIG. 1*a;*
Figure 2:
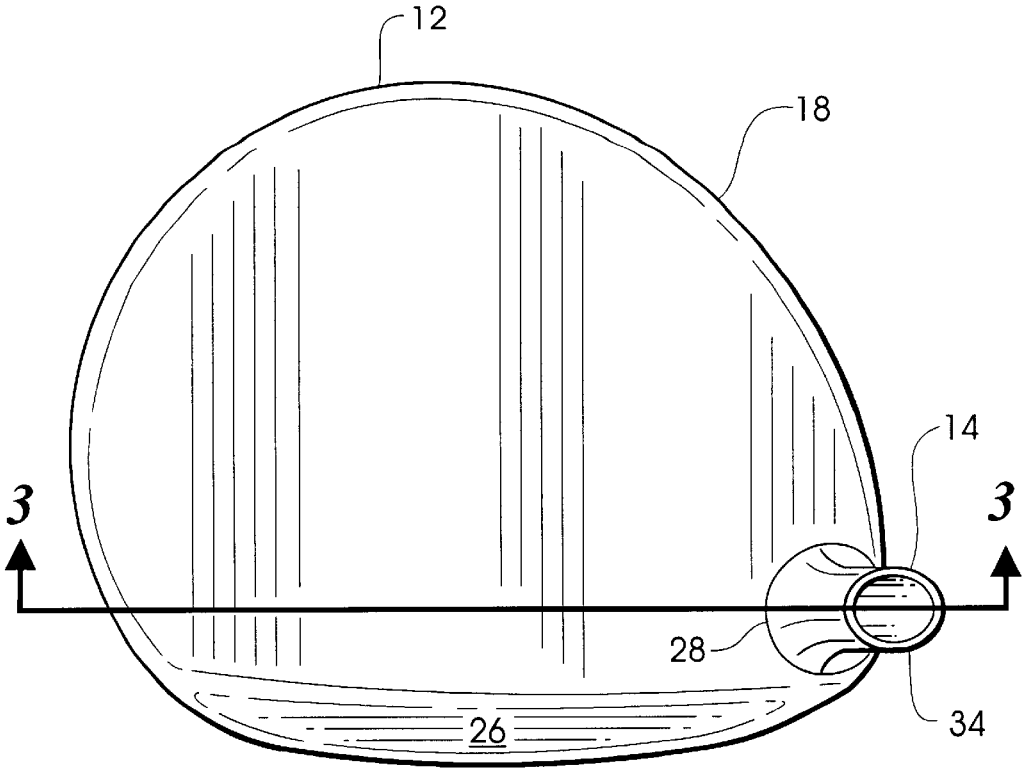
FIG. 2 is a top plan view of the golf club shown in FIG. 1.

Referring to FIG. 1, a golf club 10 includes a head 12, a hosel 14 and a shaft 16. Head 12 is comprised of a hollow body 18 made of a first material such as titanium having a high shear modulus of elasticity. The hollow body 18 has a top wall 20, a bottom wall 22, a side wall 24 connecting the top and side walls 20 and 22, and a front wall 26 arranged for impacting a golf ball. Further, the head 12 has a heel end 12*a* and a toe end 12*b*.

Figure 3:
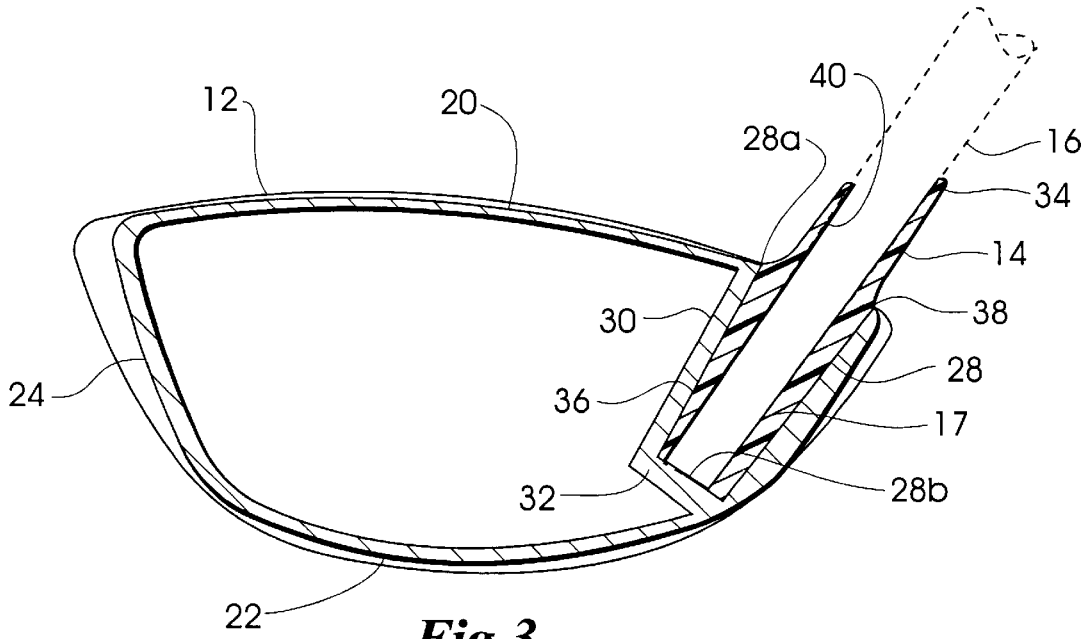
FIG. 3 is a sectional view taken along lines 3—3 in FIG. 2.
Figure 4:
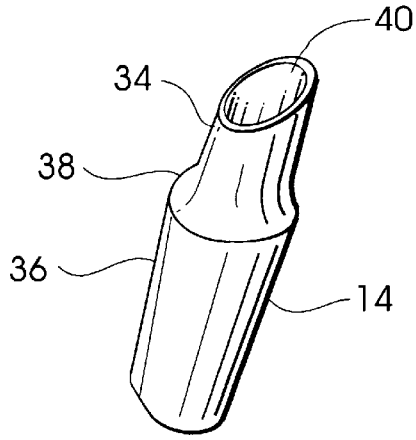
FIG. 4 is a perspective view of another part used in the golf club shown in FIGS. 1–3.
Figure 5:
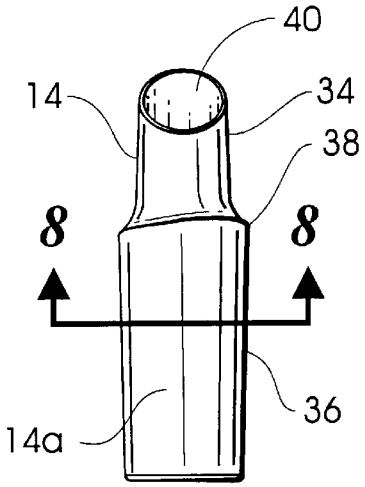
FIG. 5 is a front elevational view of the part shown in FIG. 4.
Figure 6:
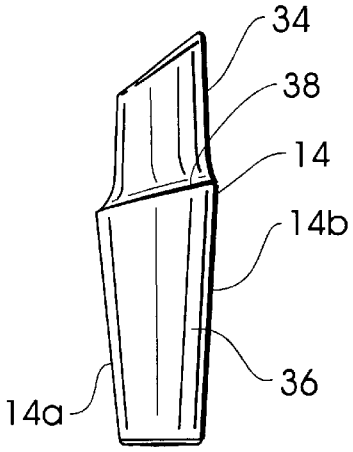
FIG. 6 is a side elevational view of the part shown in FIG. 4.
Figure 7:
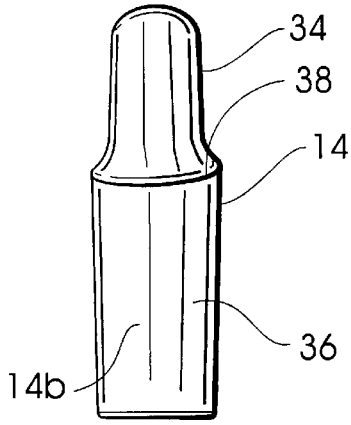
FIG. 7 is a rear elevational view of the part shown in FIG. 4.
Figure 8:
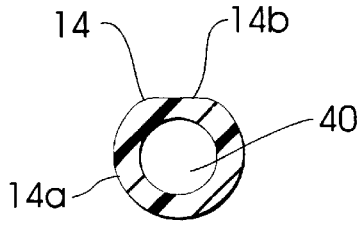
FIG. 8 is a sectional view taken along lines 8—8 in FIG. 5.

A bore 28 is provided in the heel end 12*a* of the head 12 extending downwardly from the body top wall 20 toward the body bottom wall 22. The bore 28 has a top end 28*a* which is open and a bottom 28*b* which is closed. As seen in FIG. 3, the top end 28*a* of the bore 28 is substantially flush with the top wall 20 of the body 18, and the bore bottom end 28*b* is spaced from the bottom wall 22 of the body 18. The bore 28 is defined by a lateral wall 30 connected with the side wall 24 of the body 18, and an end wall 32 connected with the lateral wall 30.

The hosel 14 is formed of a second material such as plastic having a low shear modulus of elasticity. Hosel 14 includes an upper portion 34 that extends upwardly from the top wall 20 of the body 18 and a lower portion 36 that is inserted into the bore 28. The upper and lower hosel portions 34, 36 are separated by a parting line 38. The hosel 14 also has a substantially longitudinal passage 40 extending through its upper and lower portions 34, 36. When the golf club 10 is assembled as shown in FIG. 3, the hosel 14 contacts the bottom end 32 of the bore 28.

The shaft 16 is made of a third material, preferably graphite, having a low shear modulus of elasticity. Shaft 16 has a tip end 17 received in the hosel passage 40. The shaft tip end 17 extends completely through the hosel 14 and contacts the bottom end 32 of the bore 28. In the preferred embodiment of the golf club 10, the shear modulus of elasticity of the hosel 14 is much closer to the shear elastic modulus of the shaft 16 than to the shear elastic modulus of the head 12. This relationship of elastic moduli causes the hosel 14 to absorb much of the shock resulting from the head 12 striking a golf ball on the front face 26. Therefore, less shock is transmitted to the shaft 16 which prevents breakage of the shaft 16 and permits the shaft 16 to have a weaker tip end 17 which reduces cost.

Referring to FIGS. 4–8, it is seen that the lower portion 36 of the hosel 14 has an irregular outside shape defined by a generally arcuate surface 14*a* covering its front and sides, and a generally flat surface 14*b* covering its back. The bore 28 in the head 12 has a complementary irregular inside shape defined by a generally arcuate surface 28*a* and a generally flat surface 28*b*. Therefore, the hosel 14 may be inserted into the bore 28 in only one orientation which ensures exact alignment of the shaft 16 relative to the head 12. In that orientation, the generally arcuate surfaces 14*a*, 28*a* of the hosel 14 and the bore 28 mate with each other, and the generally flat surfaces 14*b*, 28*b* of the hosel 14 and the bore 28 also mate with each other.

Since the hosel 14 is made of softer material than the head 12, the hosel 14 has a cushioning effect on the shaft 16. This cushioning effect significantly reduces the amount of vibration that is transmitted to the shaft 16 which increases shaft life.

Figure 9:
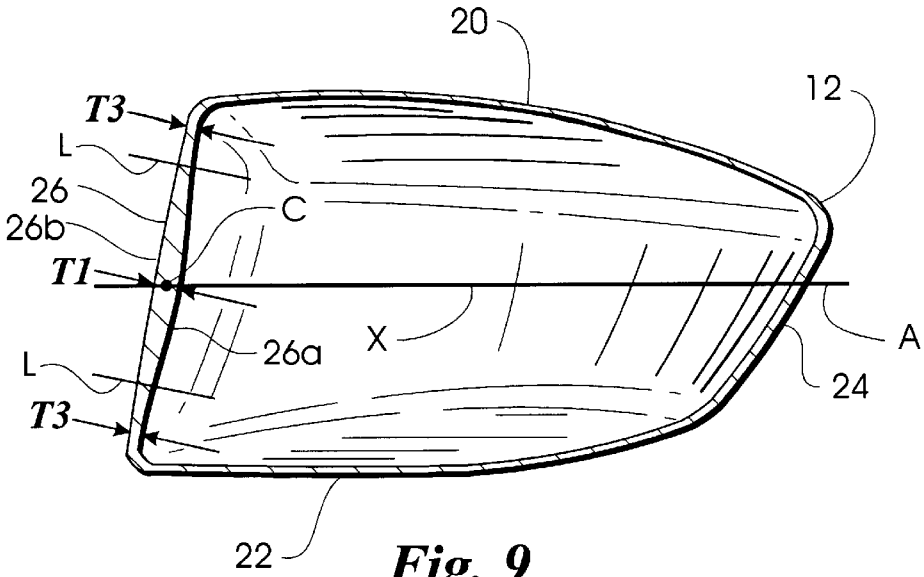
FIG. 9 is a sectional view taken along lines 9—9 in FIG. 1*b;*
Figure 10:
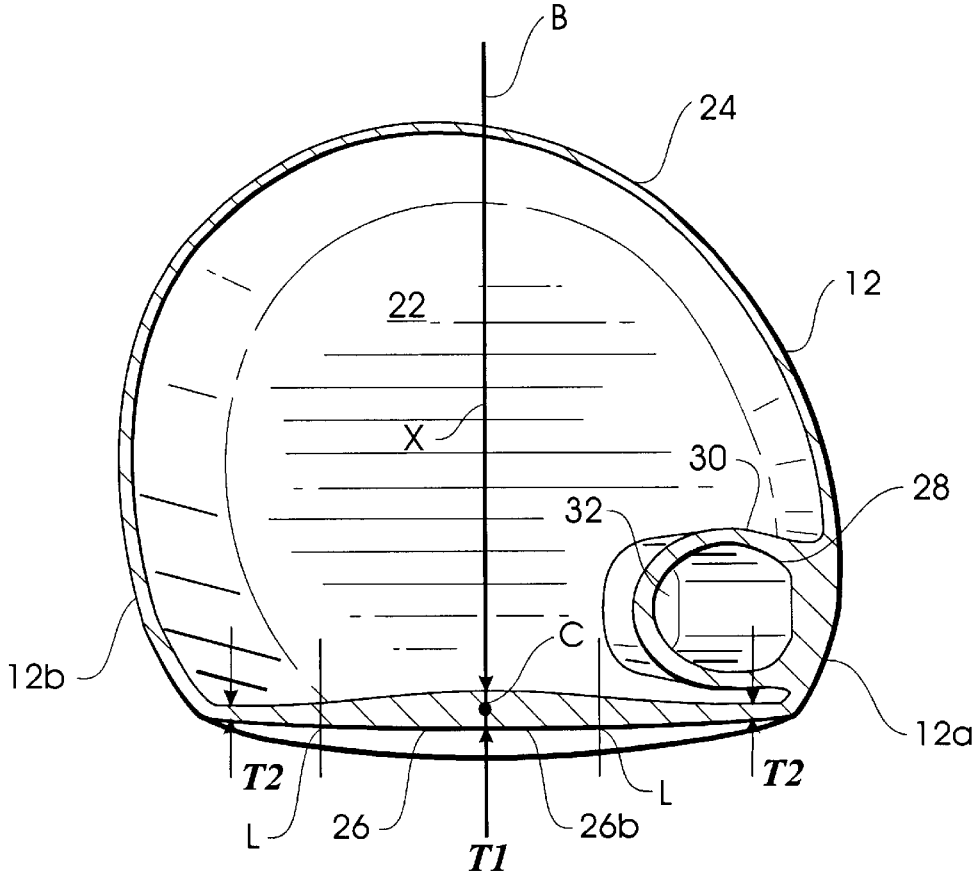
FIG. 10 is a sectional view taken along lines 10—10 in FIG. 1*b;*

Referring to FIGS. 9–10, it will be understood that the front wall 26 of the body 18 has a thickness between its inner and outer surfaces 26*a*, 26*b* when measured along lines L (which are perpendicular thereto) and reinforced by providing it with increased thickness near its geometric center C. The front wall 26 varies in thickness in a generally horizontal plane A that is disposed between the top and bottom walls 20, 22 of the body 18. The front wall 26 also varies in thickness in a generally vertical plane B that is disposed between the head heel and toe ends 12*a*, 12*b*.

As seen in FIGS. 9 and 10, the front wall 26 has a bulging area of increased thickness on its inner surface 26*a* surrounding an axis X where the planes A and B intersect. Since this axis X extends through the geometric center C of the front wall 26, the increased thickness of the front wall 26 is greatest at the geometric center C. The front wall increased thickness gradually decreases in a first direction extending from the axis X to the top wall 20, in a second direction extending from the axis X to the bottom wall 22, in a third direction extending from the axis X to the heel end 12*a*, and in a fourth direction extending from the axis X to the toe end 12*b*.

The head front wall 26 has a first thickness dimension T1 at its geometric center C, a second thickness dimension T2 adjacent the heel and toe ends 12*a*, 12*b*, and a third thickness dimension T3 adjacent the top and bottom walls 20, 22. The thickness dimension T1 is greater than the thickness dimensions T2 and T3; and the thickness dimensions T2 and T3 may be equal. In the preferred embodiment, the thickness dimension T1 is between 0.130 and 0.180 inch, the thickness dimension T2 is between 0.040 and 0.125 inch, and the thickness dimension T3 is between 0.040 and 0.125 inch.

By reinforcing the front wall 26 with the increased thickness T1 as described above, front wall 26 is strengthened at its geometric center C where loading is the greatest when impacting a golf ball. Also, by providing the front wall 26 with the decreased thickness dimensions T2 and T3, mass is redistributed to other parts of the head 12 to enhance performance of the golf club 10.

Figure 11:
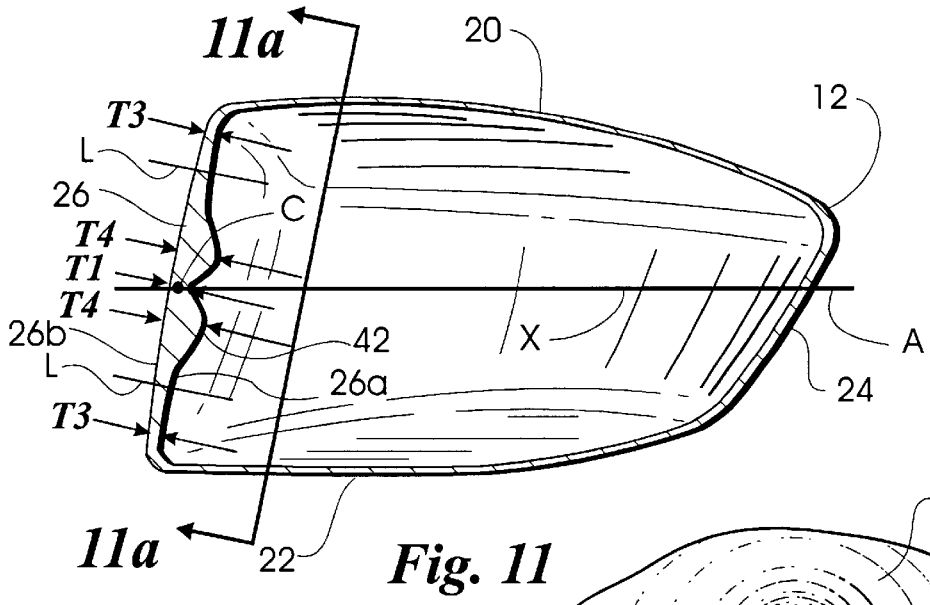
FIGS. 11 and 12 are sectional views similar to FIGS. 9 and 10, respectively, showing one embodiment of the present invention.
Figure 11A:
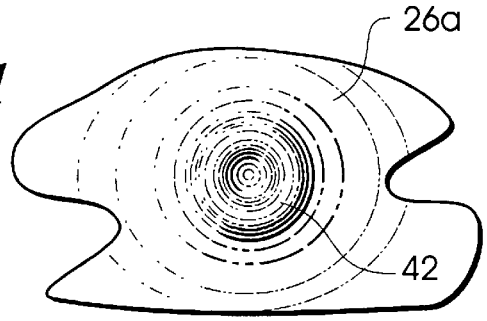
FIG. 11*a* is a sectional view taken along lines 11*a*—11*a* in FIG. 11.
Figure 12:
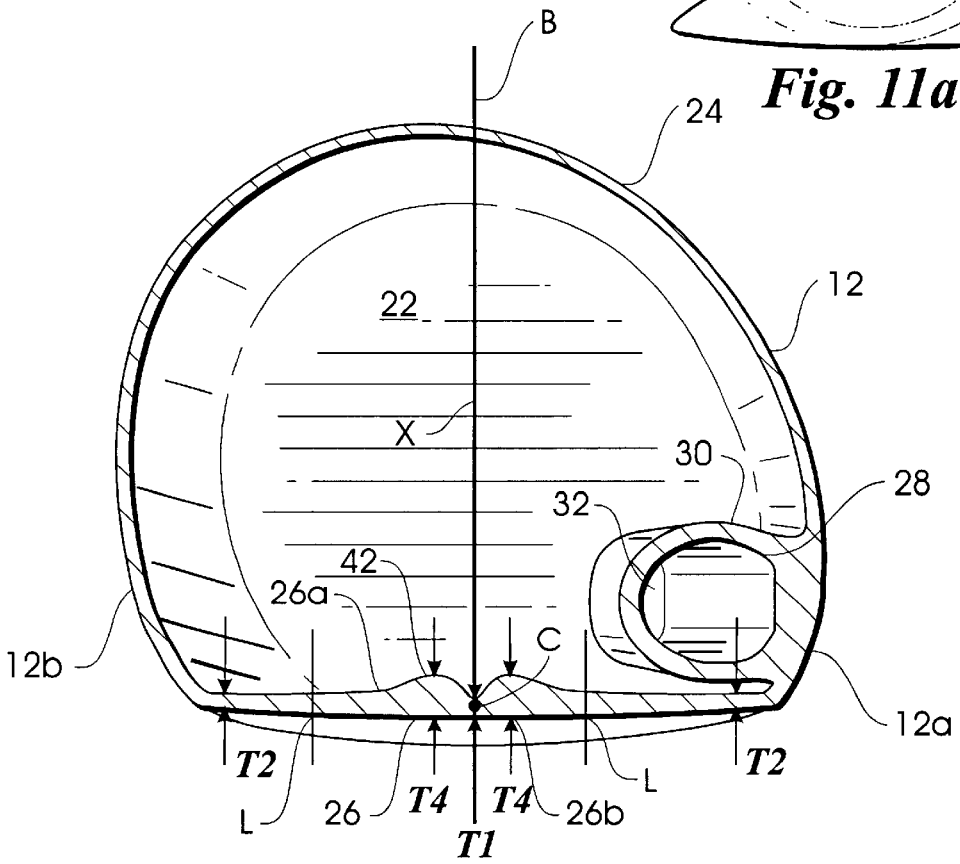

Referring to the embodiment shown in FIGS. 11, 11*a* and 12, the bulging area of increased thickness on the inner surface 26*a* of the front wall 26 includes a generally ring shaped mass 42 projecting, rearwardly from the front wall 26 and preferably encircling the geometric center C. In this embodiment, the first thickness dimension T1 is preferably between 0.090 and 0.125 inch, and the front wall 26 has a fourth thickness dimension T4 (measured through the ring shaped mass 42 at its thickest point) that is preferably between 0.140 and 0.180 inch. The fourth thickness dimension T4 is located between the geometric center C and the heel and toe ends 12*a*, 12*b* in the horizontal plane A and between the geometric center C and the top and bottom walls 20, 22 in the vertical plane B. It will be understood that the ring shaped mass 42 may form a circle as shown in FIG. 11*a*, a square, a rectangle or any other suitable geometric shape. Also, the ring shaped mass 42 may be of any desired size. For example, if the ring shaped mass 42 forms a circle as shown in FIG. 11*a*, the diameter of the circle (measured at the thickness T4) is preferably between 0.840 and 1.580 inch.

Figure 13:
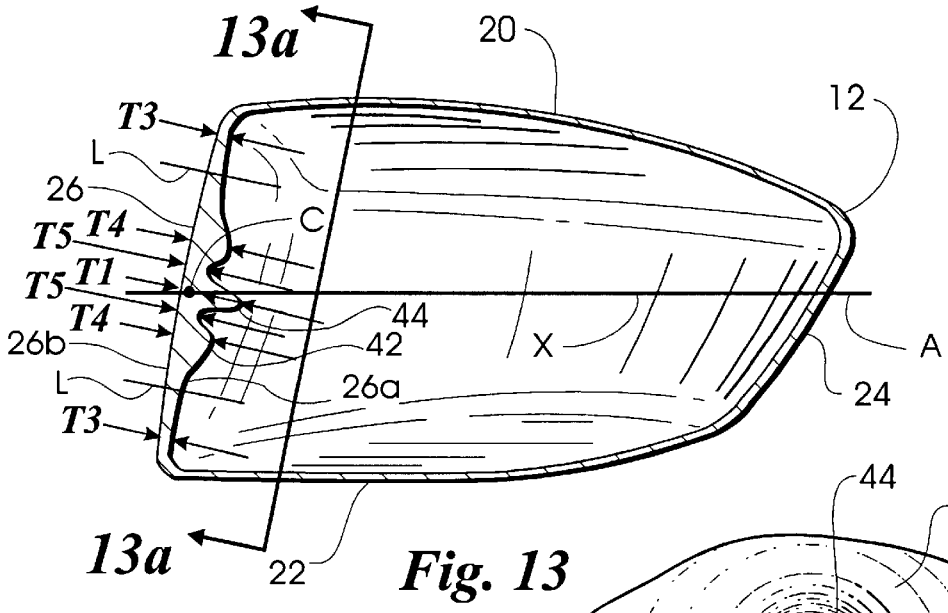
FIGS. 13 and 14 are sectional views similar to FIGS. 9 and 10, respectively, showing another embodiment of the present invention.
Figure 13A:
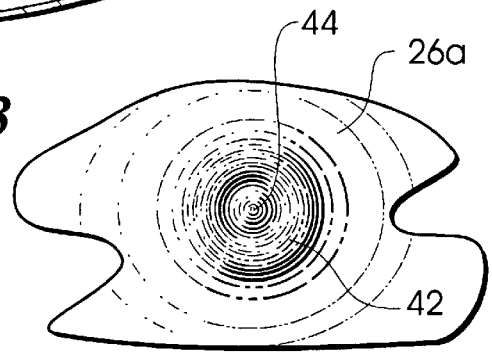
FIG. 13*a* is a sectional view taken along lines 13*a*—13*a* in FIG. 13.
Figure 14:
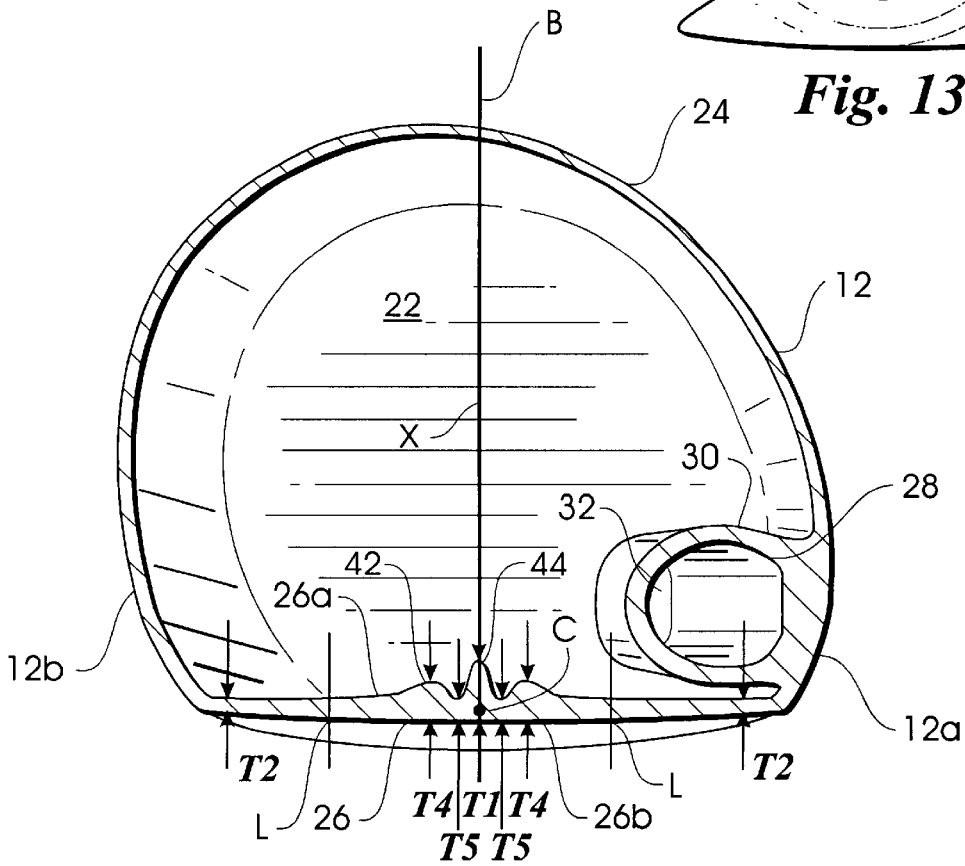

Referring to the embodiment shown in FIGS. 13, 13*a* and 14, the bulging area of increased thickness on the inner surface 26*a* of the front wall 26 includes a generally cone shaped mass 44 inside the ring shaped mass 42. The cone shaped mass 44 also projects rearwardly from the front wall 26 and is preferably located at the geometric center C. In this embodiment, the first thickness dimension T1 is preferably between 0.165 and 0.180 inch, and the front wall 26 has a fifth thickness dimension T5 (measured through the front wall 26 at a location between the ring shaped mass 42 and the cone shaped mass 44) that is preferably between 0.090 and 0.125 inch. The fourth and fifth thickness dimensions T4, T5 are located between the geometric center C and the heel and toe ends 12*a*, 12*b* in the horizontal plane A and between the geometric center C and the top and bottom walls 20, 22 in the vertical plane B.

It will be understood that the performance of the golf club 10 is further enhanced by utilizing the ring shaped mass 42 alone as in the embodiment shown in FIGS. 11 and 12 or in combination with the cone shaped mass 44 as in the embodiment shown in FIGS. 13 and 14 on the bulging area of increased thickness formed on the inner surface 26*a* of the front wall 26. In the embodiment of FIGS. 11 and 12, the front wall 26 increases in thickness when moving from the first thickness dimension T1 to the fourth thickness dimension T4 and then decreases in thickness when moving from the fourth thickness dimension T4 to the second and third thickness dimensions T2 and T3, respectively. In the embodiment of FIGS. 13 and 14, the front wall 26 decreases in thickness when moving from the first thickness dimension T1 to the fifth thickness dimension T5, then increases in thickness when moving from the fifth thickness dimension T5 to the fourth thickness dimension T4, and then decreases in thickness when moving from the fourth thickness dimension T4 to the second and third thickness dimensions T2 and T3, respectively.

What is claimed is:

1. A golf club head comprising:

a body having a top wall, a bottom wall and a front wall arranged for impacting a golf ball, said front wall having an inner surface and an outer surface; and said front wall varying in thickness and having a bulging area of increased thickness on said inner surface, said bulging area of increased thickness including a generally ring shaped mass projecting rearwardly from said inner surface of said front wall, said front wall having a maximum thickness dimension measured through said ring shaped mass, said front wall tapering in thickness from said maximum thickness dimension to a thickness dimension located inside said ring shaped mass that is less than said maximum thickness dimension, said front wall also tapering in thickness from said maximum thickness dimension to a thickness dimension located outside said ring shaped mass that is less than said maximum thickness dimension.

2. The golf club head of claim 1, further comprising a generally cone shaped mass inside said ring shaped mass, and wherein said cone shaped mass projects rearwardly from said inner surface of said front wall.

3. The golf club head of claim 2, wherein said front wall has a geometric center, and wherein said cone shaped mass is located at said geometric center.

4. The golf club head of claim 1, wherein said maximum thickness dimension is between 0.140 and 0.180 inch.

5. The golf club head of claim 4, wherein:

the thickness dimension located inside said ring shaped mass is between 0.090 and 0.125 inch; and the thickness dimension located outside said ring shaped mass is between 0.040 and 0.125 inch.

6. A golf club head comprising:

a body having a top wall, a bottom wall and a front wall arranged for impacting a golf ball, said front wall having a geometric center, an inner surface, an outer surface and a perimeter adjacent said top and bottom walls; and said front wall including a generally ring shaped stiffening region projecting rearwardly from said inner surface, said ring shaped stiffening region having a thickness that tapers from a maximum dimension disposed around the geometric center of said front wall to a dimension located proximal the perimeter of said front wall that is less than said maximum dimension in order to provide said inner surface with a smooth contour.

7. The golf club head of claim 6, wherein:

the thickness of said ring shaped stiffening region tapers from said maximum dimension which is disposed around the geometric center of said front wall to a dimension located proximal the geometric center of said front wall that is less than said maximum dimension.

8. A golf club head comprising:

a body having a top wall, a bottom wall and a front wall arranged for impacting a golf ball, said front wall having a geometric center, an inner surface, an outer surface and a perimeter adjacent said top and bottom walls; and said front wall including a locally thickened region on said inner surface surrounding said geometric center, said locally thickened region tapering from a maximum thickness dimension disposed around said geometric center to a lesser thickness dimension located proximal said geometric center, said locally thickened region also tapering from said maximum thickness dimension to a lesser thickness dimension located proximal said perimeter.

* * * * *